US008376497B2

(12) United States Patent
Chappell

(10) Patent No.: US 8,376,497 B2
(45) Date of Patent: Feb. 19, 2013

(54) CONTROL SYSTEM TO MINIMIZE INADVERTENT INK JETTING

(75) Inventor: James M. Chappell, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 198 days.

(21) Appl. No.: 12/978,697

(22) Filed: Dec. 27, 2010

(65) Prior Publication Data

US 2012/0162299 A1 Jun. 28, 2012

(51) Int. Cl.
*B41J 29/38* (2006.01)

(52) U.S. Cl. ..... 347/16; 347/14; 347/19; 347/101; 347/105

(58) Field of Classification Search ..... 347/12–14, 347/16, 19, 40, 42, 101, 104–105
See application file for complete search history.

(56) References Cited

U.S. PATENT DOCUMENTS

| | | | | |
|---|---|---|---|---|
| 3,757,171 | A | 9/1973 | Stansfield | |
| 3,928,844 | A | 12/1975 | Meihofer | |
| 5,823,696 | A | 10/1998 | Harris et al. | |
| 6,543,874 | B2 * | 4/2003 | Matsumoto | 347/19 |
| 6,663,211 | B2 * | 12/2003 | Aratsu | 347/16 |
| 6,866,357 | B1 | 3/2005 | Stehle | |
| 7,334,860 | B2 * | 2/2008 | Mitsunaga et al. | 347/19 |
| 2008/0106565 | A1 | 5/2008 | Miyazawa | |
| 2009/0101299 | A1 | 4/2009 | Wanke et al. | |

FOREIGN PATENT DOCUMENTS

| | | | |
|---|---|---|---|
| JP | 60-192678 | A | 10/1985 |
| JP | 2009-166401 | A | 7/2009 |

OTHER PUBLICATIONS

Search Report of the United Kingdom Intellectual Property Office corresponding to Application No. GB1121644.7, UKIPO, South Wales, United Kingdom, Apr. 16, 2012 (3 pages).

* cited by examiner

*Primary Examiner* — Juanita D Jackson
(74) *Attorney, Agent, or Firm* — Maginot, Moore & Beck, LLP

(57) ABSTRACT

A printer includes a web transport that is configured to transport a web of media along a transport path through the printer. Printheads in the printer are associated with web detectors that detect the presence or absence of the web opposite the printheads. A controller in the printer is operatively connected to the web detectors to alter operation of the printer with reference to the presence or absence of the web opposite the printheads.

14 Claims, 5 Drawing Sheets

CONTROL SYSTEM TO MINIMIZE INADVERTENT INK JETTING

TECHNICAL FIELD

This disclosure relates generally to web printing systems having one or more printheads that eject ink onto a moving web, and, more particularly, to operation of a web printing system upon detection of a break in the moving web.

BACKGROUND

Ink jet printers have printheads that include a plurality of inkjets for ejecting liquid ink onto an image receiving member. The ink may be stored in reservoirs located within the printer. The ink ejected by a printhead may be aqueous, oil, solvent-based, UV curable gel ink, or an ink emulsion. The gel ink may be heated to a predetermined temperature to alter the viscosity of the ink so the ink is suitable for ejection by a printhead. Another form of ink used in inkjet printers is solid ink. Solid ink may be inserted into the printer in blocks, sticks, pellets, or pastilles. The solid ink is delivered to a melting device and melted to generate liquid ink that is delivered to a printhead. The melted ink may be collected in a reservoir before being supplied to one or more printheads through a conduit or the like.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or an endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In a printer in which ink is ejected onto a moving web, the web supply may run out or the web may break. Consequently, one or more printheads may inadvertently eject drops of ink on printer components. The printing process may have to be stopped as a result to enable the printer components to be cleaned. A similar problem may arise in printers capable of printing images on different widths of media. When the width of an ink image is wider than the media receiving the ejected ink, one or more printheads positioned beyond the edges of the media may eject ink onto printer components. Again, the printing process may have to be stopped to clean the printer components. Operating a printer to avoid such stoppages would be beneficial.

SUMMARY

A printer has been developed that detects the absence and presence of a web moving through the printer. The printer includes a web transport that is configured to transport a web of media along a transport path through the printer in a process direction, a plurality of bars, each bar extends across a width of the transport path in a cross-process direction that is orthogonal to the process direction and each bar has at least one printhead mounted to the bar, a plurality of web detectors, each web detector being mounted proximate to one of the bars in the plurality of bars, each web detector being configured to detect the web of media being transported past the bar to which the web detector is mounted and to generate a signal indicative of the web of media being absent in response to the web detector failing to detect the web of media, and a controller operatively connected to the plurality of web detectors and to the printheads mounted to the plurality of bars, the controller being configured to cease operation of at least one printhead mounted to the bar in the plurality of bars that is proximate a web detector in the plurality of web detectors that is generating the signal indicative of the web of media being absent.

A method of operating a printer detects the presence or absence of a web moving through the printer. The method includes moving a web of media along a transport path in a process direction, detecting the web of media at predetermined locations along the transport path, generating a signal indicative of the web of media being absent in response to the web of media not being detected at one of the predetermined locations along the transport path, and ceasing operation of at least one printhead associated with the predetermined location at which the web of media is not being detected.

BRIEF DESCRIPTION OF THE DRAWINGS

The foregoing aspects and other features of a printer that is configured to cease operation of an image receiving member transport system when the printer senses absence of the image receiving member are explained in the following description, taken in connection with the accompanying drawings.

DETAILED DESCRIPTION

Figure 1:
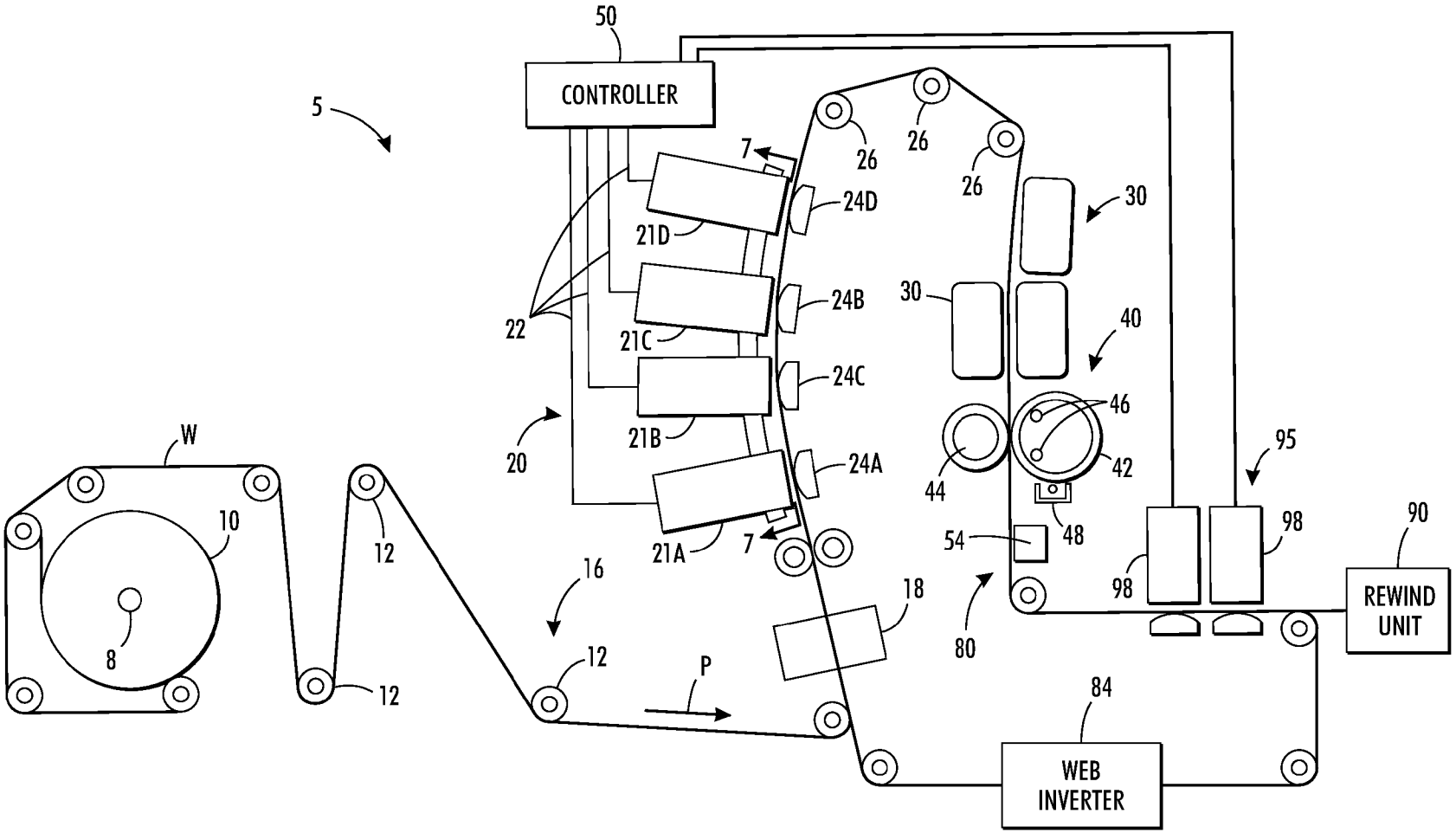
FIG. 1 is a schematic view of an improved inkjet imaging system that detects the presence of a continuous web of media as the media moves past the printheads in the system.

Referring to FIG. 1, an inkjet imaging system 5 is shown. For the purposes of this disclosure, the imaging apparatus is in the form of an inkjet printer that employs one or more inkjet printheads and an associated solid ink supply with a web moved by a web transport system. The controller, discussed in more detail below, may be configured to stop the web transport system in response to the controller receiving signals from one or more web detectors. Furthermore, the controller may be configured to selectively control the printheads in response to the controller receiving signals from one or more web detectors. The printer and methods for operating the printer that are described in this document are applicable to any of a variety of other imaging apparatuses that use inkjets to eject one or more colorants to a medium or media.

The imaging apparatus 5 includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 21D, each color unit effectively extending across the width of the media and being able to place ink directly (i.e., without use of an intermediate or offset member) onto the moving media. The arrangement of printheads in the print zone of system 5 is discussed in more detail with reference to FIG. 4. As is generally familiar, each of the printheads may eject a single color of ink, one for each of the colors typically used in color printing, namely, cyan, magenta, yellow, and black (CMYK).

The controller 50 of the printer receives velocity data from encoders mounted proximately to rollers positioned on either side of the portion of the path opposite the four color units to calculate the linear velocity and position of the web as moves past the printheads. The controller 50 uses these data to generate timing signals for actuating the inkjet ejectors in the printheads to enable the four colors to be ejected with a reliable degree of accuracy for registration of the differently colored patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color unit for each primary color may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the image receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color unit is a backing member 24A-24D, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the color units, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the color units. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to −10° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 5, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the processes for identifying printhead positions and compensation factors described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively coupled to the print bar and printhead actuators of color units 21A-21D in order to adjust the position of the print bars and printheads along the cross-process axis of the media web.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 4:
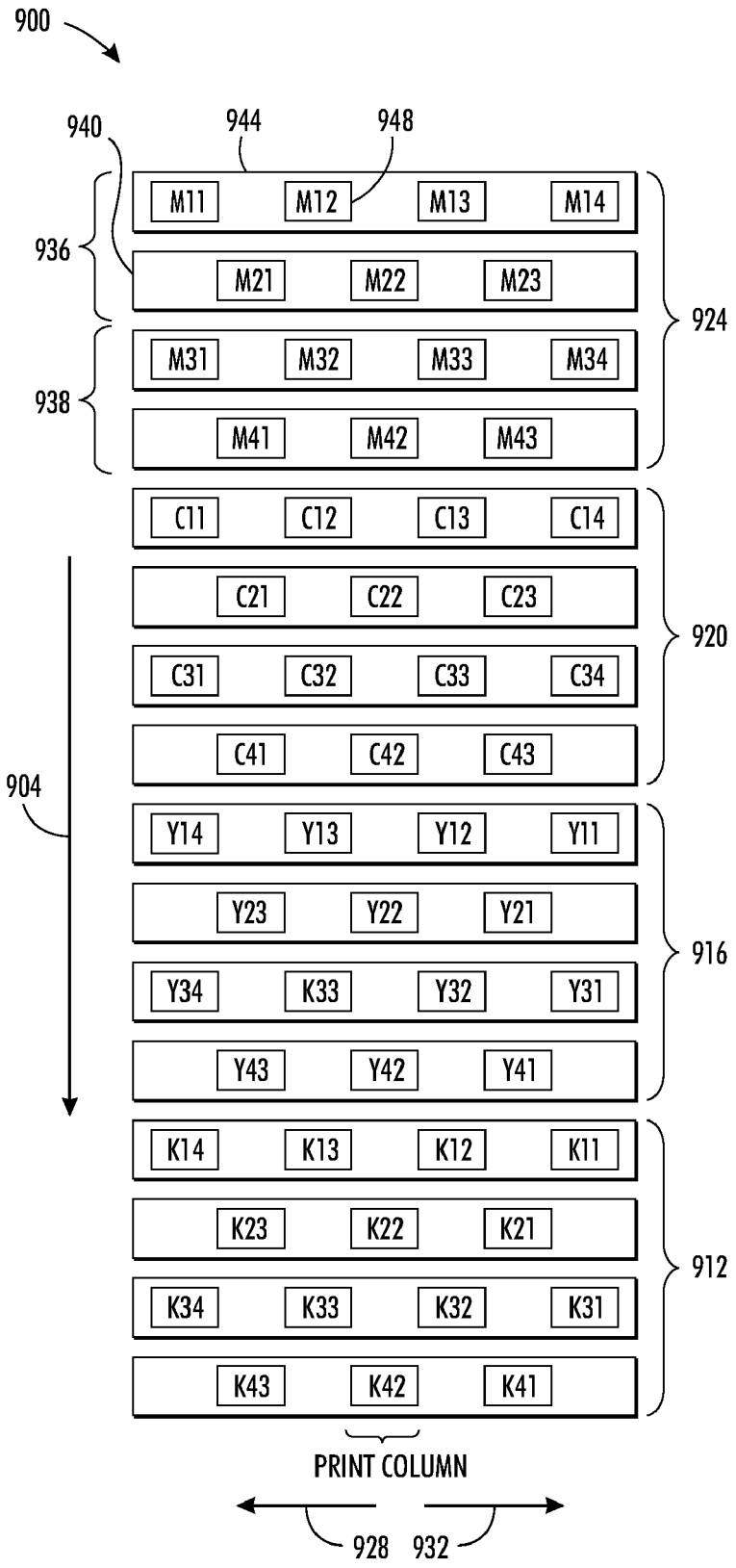
FIG. 4 is a schematic view of a printhead configuration viewed along lines 7-7 in FIG. 1.

A schematic view of a familiar print zone 900 that may be used to eject ink onto an image receiving member is depicted in FIG. 4. The print zone 900 includes four color units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print bar arrays, each of which includes two print bars that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross-process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 2:
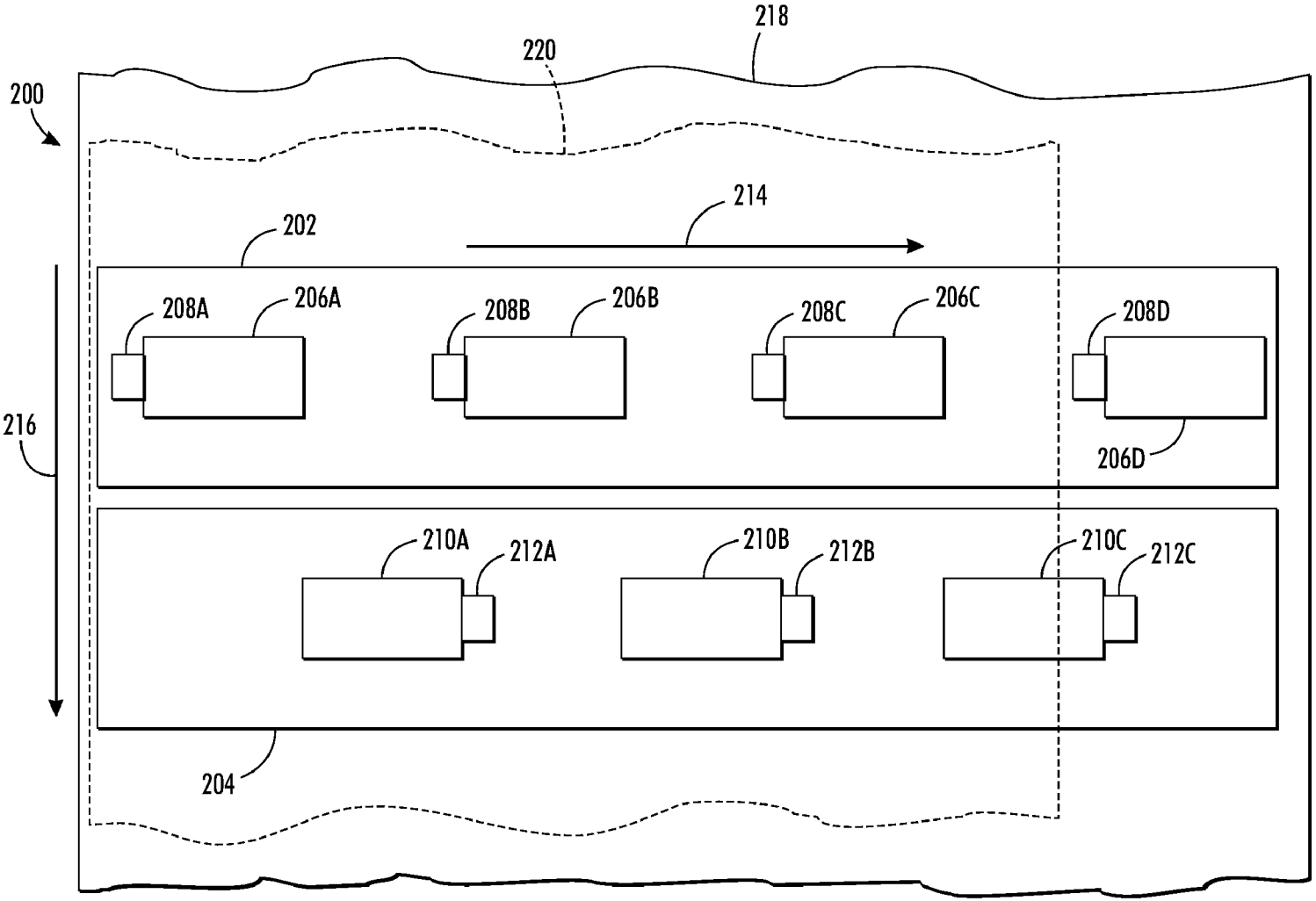
FIG. 2 is a schematic view of a print bar unit with two bars and a plurality of printheads and web detectors mounted to each bar.

FIG. 2 depicts a top view of a configuration for a pair of bars 202 and 204 that may be used in a color unit of the system 5. Each bar 202 and 204 has a plurality of printheads mounted to the bar. Each bar also includes a plurality of web detectors with each printhead mounted on a bar being associated one or more web detectors. Printheads 206A, 206B, 206C, and 206D are mounted to the bar 202 and are spaced from one another in a cross-process direction 214. The spacing between each pair of the printheads 206A-D (i.e., between 206A and 206B, between 206B and 206C, and between 206C and 206D) is configured such that they and the printheads mounted to the adjacent bar 204 (i.e., 210A, 210B, and 210C) are able to print a contiguous line across a web 218. The web 218 is transported through the printer in a process direction 216. The spacing between the bars 202 and 204 is configured based on the speed of movement of the web 218 along the process direction 216.

Each printhead 206A-D is associated with a web detector 208A, 208B, 208C, and 208D, respectively. Similarly, each printhead 210A-C is associated with a web detector 212A, 212B, and 212C, respectively. Each web detector 208A-D is mounted to the bar 202 and each web detector 212A-C is mounted to the bar 204. While the web detectors 208A-D are mounted on the left side of the printheads 206A-D, and the web detectors 212A-C are mounted to the right of printheads 210A-C, one should understand that the web detectors 208A-D and 212A-C can be mounted proximate the associated printhead at other positions about the printhead. The web detectors 208A-D and 212A-C, described in further detail below, are configured to detect whether the web 218 is positioned opposite the printhead associated with the web detector. The signals from the web detectors on a pair of bars may also be used to determine the width of the web 218. Therefore, while one web detector (208A-D and 212A-C) is shown for each associated printhead (i.e., 206A-D and 210A-C), more than one web detector may be associated with each printhead and used to detect the web 218 and determine the width of the web 218 accurately.

While the bars 202 and 204 of FIG. 2 are each depicted with a plurality of printheads (i.e., 206A-D and 210A-C, respectively) mounted to each bar, one or more of the bars may have a single printhead mounted to the bar. Such a printhead would be long enough in the cross-process direction 214 to enable ink to be ejected onto the media across the full width of the document printing area of the media. In such an embodiment, the inkjet ejectors of one printhead in a single-printhead bar can be interlaced or aligned in the process direction 216 with the inkjet ejectors of other printheads on other print bars.

Figure 3A:
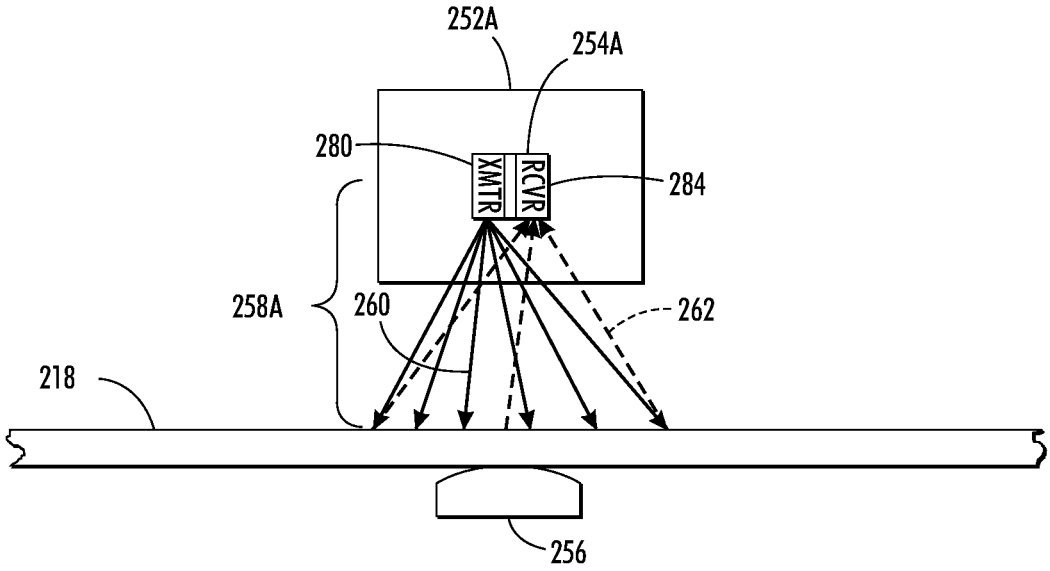
FIG. 3A is a plan side view of a printhead and a web detector that detects transmitted energy reflected by a web of media.

FIG. 3A depicts a plan side view of a printhead 252A and a web detector 254A positioned in alignment with the printhead 252A. The web 218 moves past the printhead 252A while supported by a backing member 256. The printhead 252A and the web detector 254A are each mounted to a bar (not shown), similar to the bars 202 and 204 (see FIG. 2).

The web detector 254A can be a sonic or optical type of transducer. The web detector 254A is positioned a distance 258A away from the web 218. The web detector 254A receives power from the controller 50 (see FIG. 1), and provides an electrical signal to the controller 50. The web detector 254A includes a transmitter 280 and a receiver 284. In case of a sonic web detector, the transmitter 280 is a sound generator, e.g., an ultrasound generator, which is configured to transmit pulses of sound 260. Accordingly, the receiver 284 is a sonic wave receiver configured to detect the transmitted pulses that are reflected 262 from a surface proximate the transmitter 280, a short time after the transmission. Alternatively, in case of an optical web detector, the transmitter 280 is a light emitting device, e.g., a light emitting diode, which emits light 260. Accordingly, the receiver 284 is a photodetector configured to receive light that is reflected 262 from a surface proximate to the transmitter 280. The received signal can be used to determine presence of the web 218 proximate to the printhead 252A. The distance 258A is chosen to enable the web detector 254A to provide a sweep of an area proximate the printhead 252A. As discussed above, while one web detector (i.e., 254A) is depicted in FIG. 3A, it will be understood that more than one web detector can be mounted proximate each printhead (i.e., 252A) in order to provide an accurate electronic representation of the surface proximate to the printheads.

Figure 3B:
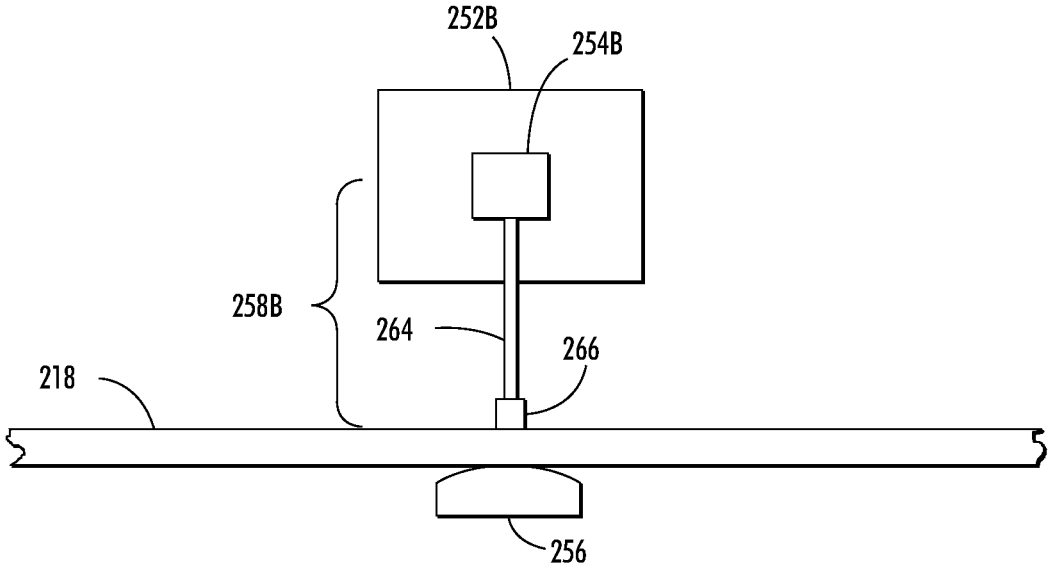
FIG. 3B is a plan side view of a printhead and a web detector that physically contacts a web of media.

FIG. 3B depicts a plan side view similar to the plan side view of FIG. 3A of a printhead 252B and a web detector 254B positioned in alignment with the printhead 252B. The printhead 252B and the web detector 254B are each mounted to a bar (not shown), similar to the bars 202 and 204 (see FIG. 2). The web detector 254B is of a mechanical type of transducer. The web detector 254B includes a collapsible rod 264 and a wheel 266. The collapsible rod is biased to enable the wheel to remain positioned at the surface of the moving web without distending the web 218 and the wheel 266 is configured to rotate on the web 218 as the web 218 moves in the process direction 216 (see FIG. 2). An electrical element, such as a resistor or capacitor, is adjusted by the movement of the collapsible rod. This electrical element may be provided in an electrical circuit that generates an electrical signal corresponding to a length of the collapsible rod. This signal is operatively connected to the controller 50 and the controller 50 compares the electrical signal to a threshold that corresponds to the full length of the collapsible rod. If the electrical signal reaches or exceeds the threshold, then the web 18 is no longer in position opposite the web detector.

In operation, the controller 50 (see FIG. 1) provides power to web detectors, e.g., 208A-D and 212A-C of FIG. 2. The controller 50 receives signals from the web detectors corresponding to presence or absence of the web proximate the web detectors. The controller 50 then operates the printer with reference to the presence or absence of the web at the positions opposite the web detectors and printheads.

Regardless of the type of web detectors used, the inkjet imaging system 5 (see FIG. 1) can be used to 1) determine whether the web is present proximate to any of the printheads and/or 2) determine the width of the web. The controller 50 is configured to selectively energize specific printheads in the inkjet imaging system 5 in response to the signals that the controller 50 receives from the web detectors. In cases where the controller 50 receives signals from all the web detectors indicating absence of the web proximate the web detectors or where the controller 50 only receives signals from a few web detectors indicating a large portion of the web is absent, the controller may be configured to cease operation of the web transport system to prevent advancement of the web elsewhere in the inkjet imaging system 5. As part of the cessation of the operation of the web transport system, the controller 50 can be configured to de-energize all the printheads to prevent ink from being ejected to non-web surfaces, e.g., the backing members 24A-D (see FIG. 1). Thus, the ink is conserved and the backing members or other printer components do not receive ink. Consequently, down time for printer cleaning can be avoided.

The controller 50 can also be configured to selectively de-energize one or some of the printheads in response to signals the controller 50 receives from the web detectors. With reference back to FIG. 2, a second web 220 is depicted in phantom for the purpose of describing the operation. The web 220 is narrower than the web 218. While web detectors 208A, 208B, 208C, 212A, and 212B each detect the web 220 and provide a corresponding signal to the controller 50 indicating the presence of the web, the web detectors 208D and 212C do not detect the web 220. As a result, the controller 50 receives signals from the web detectors 208D and 212C indicating the web is not present at the locations opposite these detectors. The distinction made between the above-mentioned web detectors can be used by the controller 50 to determine the width of the web, at least to the resolution provided by the web detectors. The controller 50 is thereby configured to selectively energize printheads 206A-C and 210A-B but de-energize printheads 206D and 210C. This selective energizing of the printheads effectively amounts to a cropping operation by the printheads. Therefore, while the original image data may require all the printheads to be energized, de-energizing one or few of the printheads proximate the edges of the web can be used to crop the image data.

Figure 5:
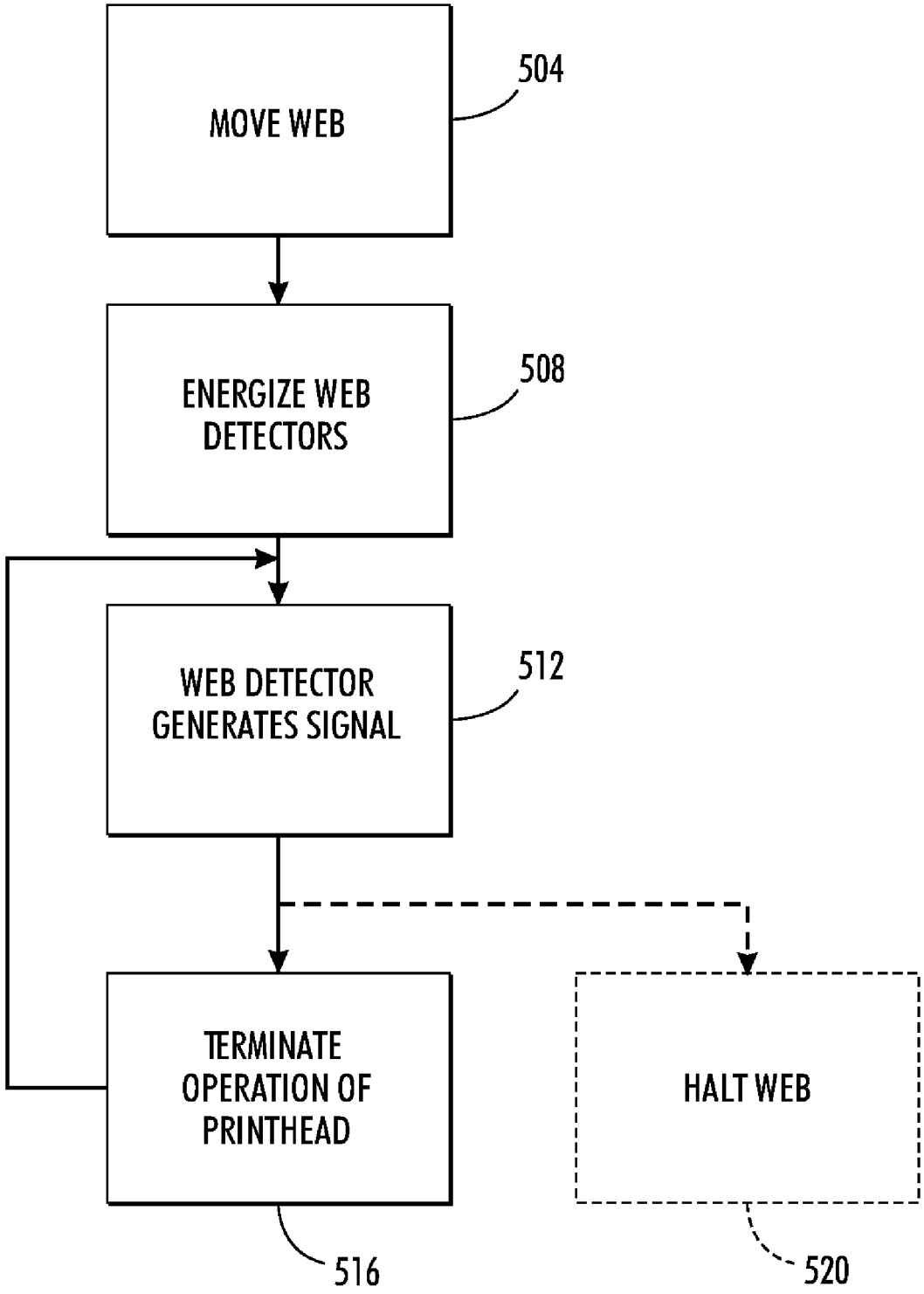
FIG. 5 is a flow diagram of a process implemented in the printer of FIG. 1.

A process for operating a printer with reference to the detection of a web in the printer is shown in FIG. 5. One or more controllers may be configured with hardware, software, or a combination of hardware and software to implement the process. The controller operates the printer to move a web of media along a transport path in a process direction through the printer (block 504) while the web detectors are energized to detect the web opposite the printheads (block 508). In response to one of the web detectors failing to detect the web of media at one of the predetermined locations along the transport path, a signal is generated that is indicative of the web of media being absent (block 512). In response to this signal, the operation of at least one printhead associated with the predetermined location at which the web of media is not being detected is terminated (block 516). Additionally, the process may halt movement of the web of media along the transport path in response to the web of media not being detected at the predetermined location (block 520).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a web transport that is configured to transport a web of media along a transport path through the printer in a process direction;

a plurality of bars, each bar extends across a width of the transport path in a cross-process direction that is orthogonal to the process direction;

a plurality of web detectors, each web detector being mounted proximate to one of the bars in the plurality of bars, each web detector being configured to detect the web of media being transported past the bar to which the web detector is mounted and to generate a signal indicative of the web of media being absent in response to the web detector failing to detect the web of media;

a plurality of printheads mounted to each bar and the printheads on each bar being spaced from one another in the cross-process direction, the printheads on adjacent bars in the process direction are configured to print a contiguous line across the web of media being transported through the printer in the process direction, each printhead having at least one web detector in the plurality of web detectors, which is mounted to the bar to which the printhead is mounted at a position proximate the printhead; and a controller operatively connected to the plurality of web detectors and to the printheads mounted to the plurality of bars, the controller being configured to cease operation of only each printhead that is proximate each web detector in the plurality of web detectors that is generating the signal indicative of the web of media being absent.

2. The printer of claim 1, the controller being further configured to cease operation of the web transport in response to at least one web detector generating the signal indicative of the web of media being absent.

3. The printer of claim 1 wherein the web detectors are sonic web detectors.

4. The printer of claim 1 wherein the web detectors are optical web detectors.

5. The printer of claim 1 wherein the web detectors are mechanical web detectors.

6. The printer of claim 1 further comprising:

the plurality of printheads mounted to each bar and the printheads being spaced from one another in the cross-process direction, the printheads on adjacent bars in the process direction are configured to print a contiguous line across the web of media being transported through the printer in the process direction;

each printhead having at least one web detector mounted to the bar to which the printhead is mounted at a position proximate the printhead; and the controller is further configured to cease operation of only each printhead proximate each web detector generating the signal indicative of the web of media being absent.

7. A method of operating a printer comprising:

moving a web of media along a transport path in a process direction;

detecting the web of media at predetermined locations along the transport path;

generating a signal indicative of the web of media being absent in response to the web of media not being detected at one of the predetermined locations along the transport path;

ceasing operation of at least one printhead associated with the predetermined location at which the web of media is not being detected; and halting movement of the web of media along the transport path in response to the web of media not being detected at the predetermined location.

8. The method of claim 7 wherein the web of media is detected with sonic web detectors.

9. The method of claim 7 wherein the web of media is detected with optical web detectors.

10. The method of claim 7 wherein the web of media is detected with mechanical web detectors.

11. A printer comprising:

a web transport that is configured to transport a web of media along a transport path through the printer in a process direction;

a plurality of bars, each bar extends across a width of the transport path in a cross-process direction that is orthogonal to the process direction and each bar has at least one printhead mounted to the bar;

a plurality of web detectors, each web detector being mounted proximate to one of the bars in the plurality of bars, each web detector being configured to detect the web of media being transported past the bar to which the web detector is mounted and to generate a signal indicative of the web of media being absent in response to the web detector failing to detect the web of media; and a controller operatively connected to the plurality of web detectors and to the printheads mounted to the plurality of bars, the controller being configured to cease operation of at least one printhead mounted to the bar in the plurality of bars that is proximate a web detector in the plurality of web detectors that is generating the signal indicative of the web of media being absent and being configured to cease operation of the web transport in response to at least one web detector generating the signal indicative of the web of media being absent.

12. The printer of claim 11 wherein the web detectors are sonic web detectors.

13. The printer of claim 11 wherein the web detectors are optical web detectors.

14. The printer of claim 11 wherein the web detectors are mechanical web detectors.

* * * * *